US008746348B2

(12) United States Patent
Reed et al.

(10) Patent No.: US 8,746,348 B2
(45) Date of Patent: Jun. 10, 2014

(54) APPARATUS, SYSTEM AND METHOD FOR RELEASING FLUIDS FROM A SUBSEA RISER

(75) Inventors: Larry D. Reed, Spring, TX (US); Russell E. Hegler, Hockley, TX (US); Robert B. Baten, Houston, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 534 days.

(21) Appl. No.: 13/019,026

(22) Filed: Feb. 1, 2011

(65) Prior Publication Data

US 2011/0209876 A1 Sep. 1, 2011

Related U.S. Application Data

(60) Provisional application No. 61/305,823, filed on Feb. 18, 2010.

(51) Int. Cl.
*E21B 17/01* (2006.01)

(52) U.S. Cl.
USPC ..... 166/345; 166/367; 405/224.2

(58) Field of Classification Search
USPC ..... 166/345, 338, 340, 351, 352, 358, 359, 166/363, 364, 367, 66.7, 87.1, 332.1, 166/332.6; 405/224.2; 251/324, 326
See application file for complete search history.

(56) References Cited

U.S. PATENT DOCUMENTS

| | | | | |
|---|---|---|---|---|
| 3,855,656 | A * | 12/1974 | Blenkarn | 441/22 |
| 3,981,360 | A * | 9/1976 | Marathe | 166/317 |
| 4,059,148 | A * | 11/1977 | Blomsma | 166/359 |
| 4,099,560 | A * | 7/1978 | Fischer et al. | 166/350 |
| 4,176,986 | A * | 12/1979 | Taft et al. | 405/211 |
| 4,210,208 | A * | 7/1980 | Shanks | 166/352 |
| 4,621,655 | A * | 11/1986 | Roche | 137/81.2 |
| 4,626,135 | A * | 12/1986 | Roche | 405/224.2 |
| 4,719,937 | A * | 1/1988 | Roche et al. | 137/114 |
| 4,832,126 | A * | 5/1989 | Roche | 166/358 |
| 5,826,658 | A * | 10/1998 | Harthorn et al. | 166/339 |
| 6,123,151 | A * | 9/2000 | Regan et al. | 166/367 |
| 6,450,262 | B1 * | 9/2002 | Regan | 166/350 |
| 6,470,975 | B1 * | 10/2002 | Bourgoyne et al. | 175/57 |
| 8,210,264 | B2 * | 7/2012 | Mohr | 166/343 |
| 2004/0031623 | A1 * | 2/2004 | Fontana | 175/7 |
| 2007/0095540 | A1 * | 5/2007 | Kozicz et al. | 166/358 |

FOREIGN PATENT DOCUMENTS

| | | |
|---|---|---|
| WO | 8605231 | 9/1986 |
| WO | 2010/069992 | 6/2010 |

OTHER PUBLICATIONS

International Search Report and Written Opinion for PCT/US2011/025201 dated Aug. 29, 2011, 6 pages.

* cited by examiner

*Primary Examiner* — Matthew Buck
(74) *Attorney, Agent, or Firm* — John E. Vick

(57) ABSTRACT

An apparatus, system and method for releasing fluid from a subsea marine riser is disclosed. A housing defines an interior space and an exterior region. The housing includes first and second ends adapted for respective sealed connection in a marine riser assembly. The housing may be defined on its interior space by a central cavity adapted for passage of a drill string. A plurality of ports may be provided for fluid release from the housing upon emergency disconnect of the riser from a subsea well. One or more gates may be provided in mating configuration with the housing. The gates may be moveable from a sealed position that restricts fluid flow through the ports to an open position that facilitates fluid release from the riser through the ports.

21 Claims, 7 Drawing Sheets

APPARATUS, SYSTEM AND METHOD FOR RELEASING FLUIDS FROM A SUBSEA RISER

CROSS REFERENCE TO RELATED APPLICATIONS

This application claims priority to previously filed U.S. provisional application, Ser. No. 61/305,823 to Bolen et al., filed in the United States Patent Office on Feb. 18, 2010.

FIELD OF THE INVENTION

The invention is directed to the field of subsea drilling.

BACKGROUND

Hydrocarbons may be produced from wells drilled below the surface of the sea. In conventional subsea drilling, a riser contains a drilling string, also known as a drilling pipe. A drilling mud column travels through the drilling string from an offshore drilling rig and downward to the bottom of a wellbore being drilled. Drilling mud then returns with cuttings upward along the outside of the drilling string in the annulus region of the riser to the drilling rig.

To drill subsea wells in a deep ocean environment, it may be useful to employ a drilling technique known as dual gradient drilling. Dual gradient drilling is a drilling technique employing drilling mud in the drill string down to the wellbore. It employs a drilling mud return path that does not follow the annulus but instead travels by a different route. In dual gradient drilling it is possible to employ a subsea rotating device above the lower marine riser package. A subsea rotating device functions to seal the annulus between the riser and the drill string. This separates drilling mud in the annular region below the subsea rotating device from seawater or seawater equivalent fluid employed in the annular region above the subsea rotating device.

When drilling in subsea environments, it is sometimes necessary to conduct an emergency disconnect of the lower marine riser package from the blowout preventer stack located adjacent to the sea floor. Emergency disconnects may occur, for example, during severe weather, when sea conditions result in high waves, winds and or currents. Emergency disconnect during dual gradient drilling operations may trap seawater or seawater equivalent fluid within the riser. A drilling vessel with a suspended freely hanging riser during severe weather conditions presents challenges due to the substantial weight of the riser suspended from the vessel. Vessels heave up and down in heavy storms, and such a suspended riser may move vertically up and down, inducing stress upon the riser, with the potential to cause failure and loss of the riser. In such conditions, it would be desirable to minimize the weight or mass of the riser. Trapped seawater or seawater equivalent fluids in the riser adds additional weight and mass to the riser, which is undesirable.

An apparatus, system and method for reliably discharging seawater or seawater equivalent fluids in the event of riser disconnect would be highly desirable. The invention is directed to such operational challenges.

SUMMARY OF THE INVENTION

An apparatus, system and method is disclosed for releasing fluid from a marine riser assembly. In one embodiment, it is useful to release the fluid as close the lower end of the riser as possible. The apparatus, sometimes referred to as a dump joint apparatus, or "RDJ", may comprise a housing defining an interior space and an exterior region. The housing may include first and second ends adapted for respective sealed connection in a marine riser assembly. The housing may be defined on its interior space by a central cavity, the central cavity being adapted for passage of a drilling string and associated tools; casing or seals. Further, the housing may include at least one port adapted for fluid exit. A first gate is provided in mating configuration with the housing, the first gate being moveable from (i) a sealed position that restricts fluid flow through the port to (ii) an open position that facilitates fluid flow through the port from the interior space to the exterior region of the housing. A first actuator assembly may be connected to the first gate and configured for moving the first gate from the sealed position to the open position in response to a signal or hydraulic pressure. The first actuator assembly may be hydraulically or mechanically operated.

In one embodiment of the invention, the first actuator assembly may be provided in fluid communication with stored hydraulic fluid. The actuator assembly may have at least one valve or other operable flow restrictive device. The valve may be configured for opening in response to a signal or pressure pulse to facilitate pressurized flow of the hydraulic fluid to move the first gate to the open position.

The apparatus may include a second gate in mating configuration with the housing. The second gate may be controlled independently of the first gate and may be selectively moveable from (i) a sealed position that restricts fluid flow through the ports to (ii) an open position that facilitates fluid flow through the ports from the interior space to the exterior region of the housing. The apparatus further may comprise a second actuator assembly connected to the second gate and configured for moving the second gate from the sealed position to the open position in response to a signal or hydraulic pressure. In yet another embodiment, a third gate may be employed, in which the third gate is connected to a third actuator assembly. A fourth gate may be connected to a fourth actuator assembly. Additional gates may be employed as well.

In one embodiment of the invention, the first and third gates are positioned on approximately opposite sides of the housing so as to release water in an effective and efficient manner from the housing of the apparatus. The second and fourth gates may be positioned on approximately opposite sides of the housing as well, such that if either actuator assembly should not be deployed and activated for any reason, drilling fluid (or seawater equivalent fluid) still may be released from the housing. In this way, redundancy may be built into the apparatus and system of the invention to ensure that fluid is released from the housing even if a portion of the system fails to operate as planned.

A first set of actuator assemblies may be employed with any number of gates in the event of an emergency disconnect from the well. One or more control systems may activate sets of actuator assemblies in the event of an emergency disconnect from the well, thereby facilitating redundant operation. The failure of one control system to function will still result in drilling fluid being released from the housing in adequate volume, if a second control system is employed in independent fashion.

The housing may be cylindrical or hexagonal in shape, but shall not be limited in arrangement options. In another aspect of the invention, a first set of gates may be distributed in a spaced arrangement along the periphery of the housing, with each being connected to a first set of actuator assemblies. Furthermore, the second, fourth, and sixth gates may be distributed in a spaced arrangement upon the housing and connected to a second set of actuator assemblies, in other embodiments.

In another embodiment of the invention, a first end of the housing may be adapted for connection to a riser joint. The second end of the housing may be adapted for connection to a subsea rotating device, or to another riser section, or another device.

An apparatus is disclosed for releasing fluid from a riser assembly. The riser assembly may be adapted for connection to a drilling structure positioned above the surface of the sea. The riser assembly may be configured for extending below the sea to a lower marine riser package ("LMRP") or similar structure. The LMRP typically is mounted upon a blowout preventer ("BOP") adjacent the top of the subsea wellhead. In one embodiment of the invention, the BOP and/or LMRP may be configured for sending pressurized hydraulic fluid to the actuating system upon activation of the BOP. This may occur when the BOP is actuated to shut in a well during an emergency. In that instance, the riser becomes disconnected, and at that point the need for releasing fluid from the riser may be satisfied by actuation of one or more gates, as further disclosed herein.

In some embodiments of the invention, the first set of gates further include apertures as part of their structure. The apertures may be provided for alignment with ports of the housing when the first set of gates are in the open position. A second set of gates may be provided, the second set of gates being in mating configuration with the housing. The second set of gates may be selectively moveable from a sealed position that restricts fluid flow through ports to an open position that facilitates fluid flow through ports from the interior space to the exterior region of the housing. The second set of gates also could employ apertures for alignment with respective ports.

The invention may comprise a system for receiving a drill string. The system may be suspended from a drilling structure, such as a drillship, a floating platform, jack-up platform, or other structure. The system may comprise a riser, the riser being configured for the transport of drilling fluid. Further, the system may be sealed in connection to the riser.

A method also is provided for releasing fluids from a drilling riser in the event of an emergency disconnect of the riser from a well. The method may comprise the steps of providing a fluid release apparatus in sealed connection to a riser, the fluid release apparatus comprising a housing defining an interior space and an exterior region. The apparatus employed in the method may further comprise at least one port and a gate in mating configuration to the port. The gate may be moveable from a sealed position which blocks fluid flow through the port to an open position that facilitates fluid flow through the port. Furthermore, a first actuator assembly moves the gate from the sealed position to the open position. Further, the first actuator assembly may be activated to move the gate to the open position. Fluid then may move from the interior space of the riser through the port to the exterior region of the riser.

In some instances, the first actuator assembly may be hydraulically operated. If hydraulics are employed, hydraulic fluid may be in communication with the actuator assembly. The actuator also may comprise at least one valve. During the activation step, such a valve may be opened by pressure or other means to facilitate pressurized flow of the hydraulic fluid to move the first gate to the open position. A plurality of ports can be employed. A second gate may be provided as well. The second gate may be moveable from a sealed position which covers at least one port to an open position that facilitates fluid flow through at least one port. Any number of gates may be used in the practice of the invention. One or more control systems may be configured for receiving a signal and activating the actuator assembly upon emergency disconnect of the riser from the well.

BRIEF DESCRIPTION OF THE FIGURES

The invention may be observed by reference to one or more Figures as follows.

DETAILED DESCRIPTION OF THE INVENTION

While the invention is shown in one or more detailed embodiments, it is recognized that other embodiments of the invention could be conceived and deployed in accordance with the scope of the written description herein, and the invention is not limited to only those embodiments illustrated in the Figures.

Figure 1:
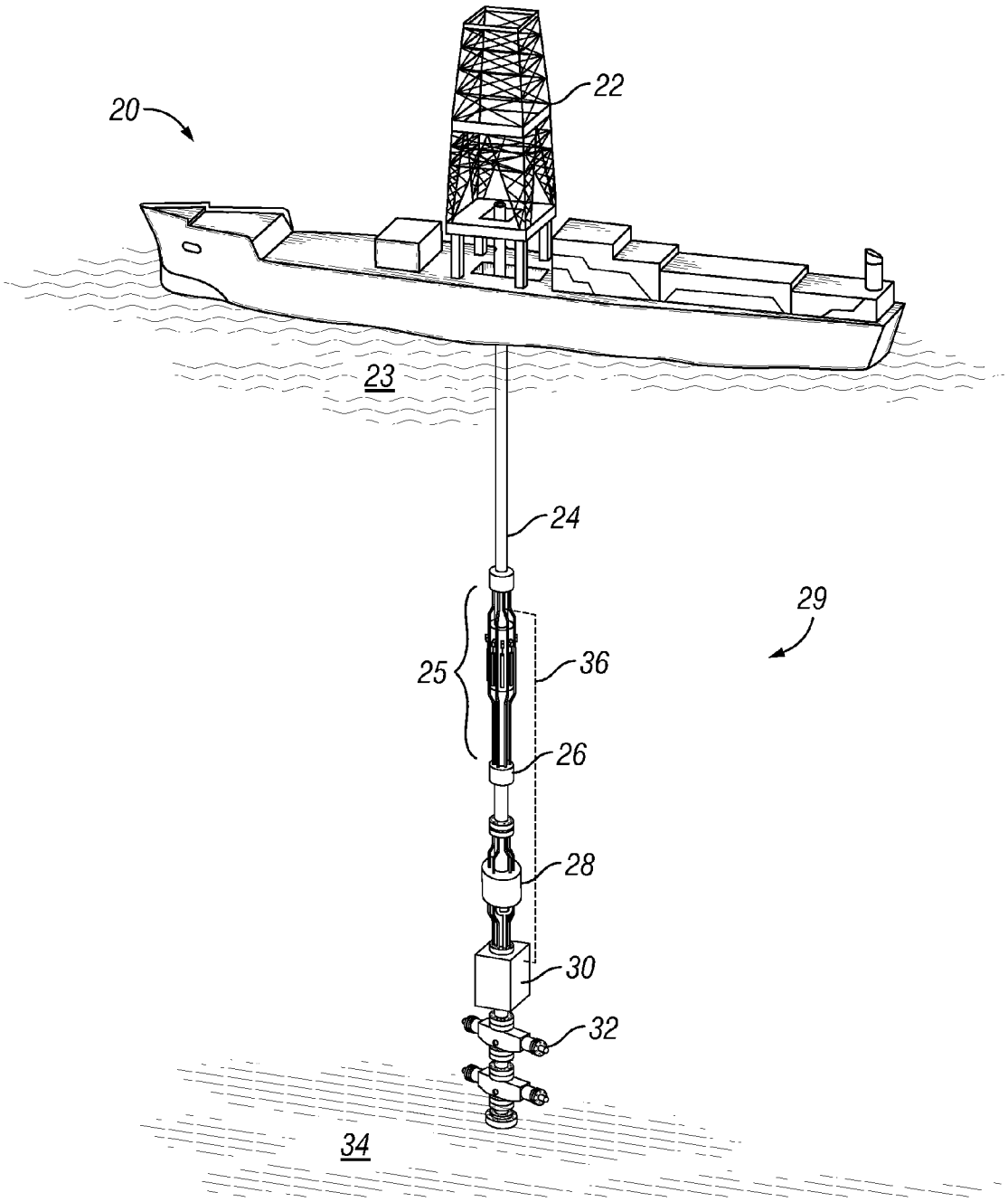
FIG. 1 illustrates an overall view of the system and apparatus to be employed in practicing the invention.

In FIG. 1, a drilling vessel 20 is shown having derrick 22, the drilling vessel 20 positioned in a body of water 23. Suspended from the derrick 22 is a riser 24 and a marine riser assembly 29. A dump joint apparatus 25 ("RDJ") is provided inline as part of the riser 24, and may be connected to a subsea rotating device 26 ("SRD"). Furthermore, a solids processing unit 28 ("SPU") also is shown, which reduces the size of solid cuttings brought up during drilling of the subsea well. Below the solids processing unit 28 is a mudlift pump and lower marine riser package 30 ("LMRP") atop a blow out preventer 32 ("BOP"), which is positioned near sea floor 34. A control line 36 extends from the blow out preventer 32 or the LMRP 30 to the dump joint apparatus 25, as further discussed herein. Although the system shown and described here is suitable for dual gradient drilling, it should be noted that the invention of this application could be used to release fluid from a riser in either conventional or dual gradient drilling, with appropriate modifications.

In the event of an emergency disconnect, lower marine riser package 30 may disconnect from the blow out preventer 32, which allows the riser 24 with associated hardware to freely hang beneath the vessel. Following emergency disconnect, it is possible to release fluid from the interior of the riser through the dump joint apparatus 25.

Figure 2A:
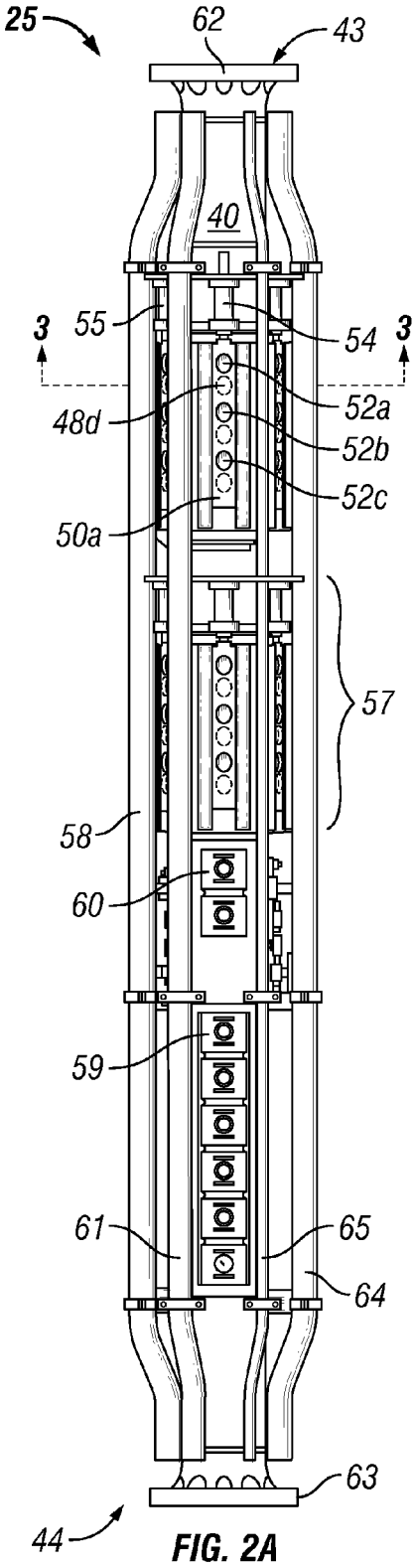
FIG. 2A shows the dump joint apparatus of the present invention with the gates in the closed position.

FIG. 2A shows a view of the dump joint apparatus 25 with gates 50*a-f* (see also FIG. 3) in the closed position. Note that not all gates 50*a-f* are visible in FIG. 2A, but gates 50*a-f* may be seen in FIG. 3. A housing 40 is illustrated, which has an exterior region 41 and interior space 42. Interior space 42 (see FIG. 3) typically is fluid filled during drilling operations, which may include drilling mud or in the case of dual gradient drilling may include seawater or seawater-weight equivalent fluid. The housing 40 includes a first end 43 and a second end 44, and each of such ends 43-44 are adapted for flanged connection within the riser string by way of upper riser flange 62 and lower riser flange 63, respectively.

Figure 2B:
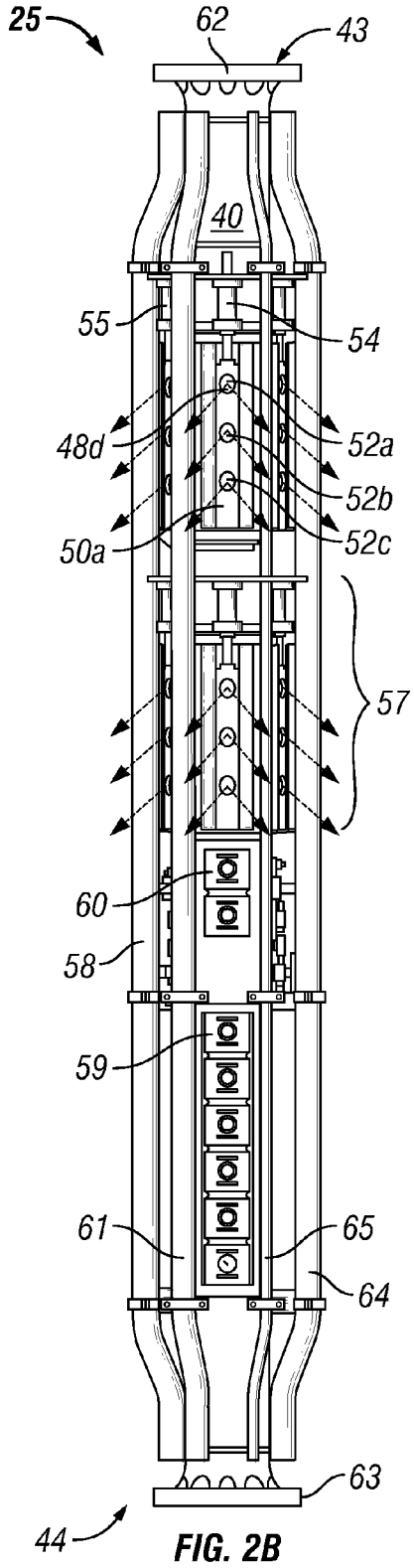
FIG. 2B illustrates the dump joint apparatus of FIG. 2B with the gates in the open position, facilitating release of fluid from the apparatus.

Gate 50*a* is shown near the top portion of FIG. 2A, and this gate and others (not shown) are capable of actuation to open to a position as shown in FIG. 2B to release fluid held within the riser 24 as shown in the directional arrows of FIG. 2B. Port 48*d* is shown in dotted line in FIG. 2A, as it is underneath the gate 50*a* and out of alignment with aperture 52*a*. When the gate 50*a* is actuated and moved downward, however, the port 48*d* comes into alignment with aperture 52*a*, allowing the passage of fluid out of the dump joint apparatus 25. Likewise, other ports 48*a*, 48*b*, 48*c*, 48*e*, and 48*f* are capable of aligning with respective gate apertures (such as apertures 52*b* and 52*c* of FIG. 2A) to provide a similar fluid pathway. Some of these structures also may be seen in FIG. 3.

A first actuator assembly 54 is configured to move the gate 50*a*, as further discussed herein. A second actuator assembly 55 is also shown in FIG. 2A, and is configured for moving gate 50*b* (gate 50*b* can be seen in FIG. 3). Any number of actuator assemblies may be configured to move such gates, and it is possible in some embodiments for one actuator assembly to move multiple gates, although the embodiment of the invention seen in FIGS. 2A-2B employs one actuator assembly per gate.

A redundant flow port section 57 is configured in a similar manner, and provides additional capacity for release of fluid from assembly 25. In one embodiment of the invention, the redundant section may include an array of sliding gates that are actuated by a hydraulic cylinder that is operated by a control circuit, as further discussed herein. Upon receiving a pilot signal from the BOP control, the dump circuit may fire two position valves (not shown) that allow stored hydraulic fluid to actuate the gates to the open position to uncover ports. This manner of operation is further discussed herein, and also in connection with FIG. 4.

Remotely operated vehicles may interact with the apparatus 25 by mechanically engaging ROV intervention connection section 59, which includes multiple points for interconnection and actuation by an ROV vehicle. This may be used, for example, to reset the apparatus 25 back to the open position following a reconnection of the riser 24 to the blow out preventer 32. In other applications of the invention, the ROV vehicle could be used to actuate the apparatus 25 to release fluid in the event of an equipment malfunction which causes the apparatus 25 to fail in the automatic mode to deploy gates for release of riser fluid. In such instances, manual intervention may be used to open gates and release fluid.

Mud return line 58 and choke line 61 may be seen running the length of the apparatus 25. Further, seawater fluid power line 64 and rigid conduit line 65 also run the length of the apparatus 25. Housing 40 has an exterior region 41 and an interior space 42. Controls 60 are provided and shown in FIGS. 2A and 3A, and may be employed to provide means to remotely operate the apparatus 25.

Figure 3:
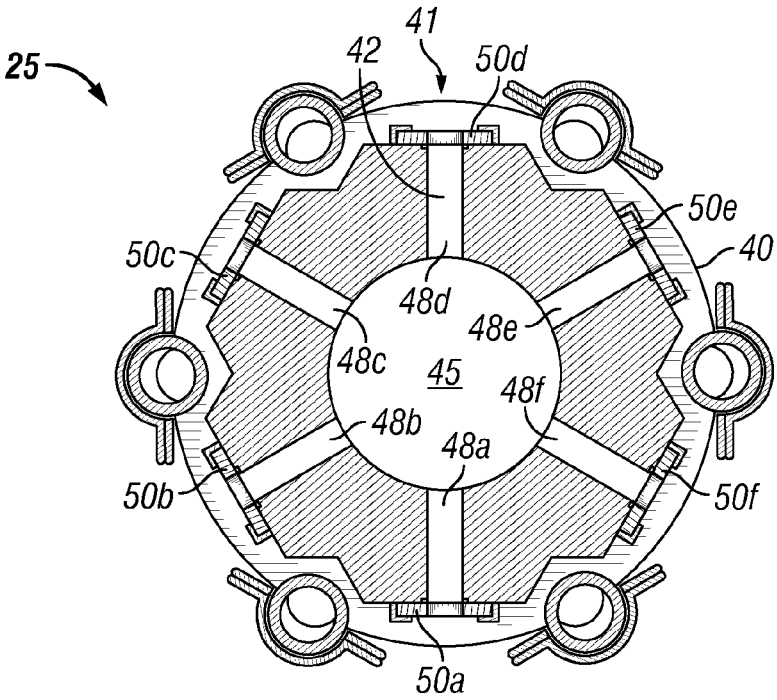
FIG. 3 shows a cross sectional view of the apparatus of FIG. 2A.

FIG. 3 illustrates a cross sectional view of apparatus 25, in which gates 50*a-f* can be seen around the periphery of the cylindrical or hexagonal shaped apparatus 25. In the embodiment shown, each gate is coupled with an actuator so that there is one actuator for every gate. However, in other embodiments of the invention, the gates 50*a*, 50*c* and 50*e* could be controlled by a first actuator assembly, while gates 50*b*, 50*d*, and 50*f* could be controlled by a second actuator assembly 55. In this manner, the failure of one actuator assembly would result in one-half of the gates not working, but the other gates still would retain the fluid release capacity to release fluid from the riser 24 in an efficient manner. Thus, the gate and actuator arrangement could be deployed in any manner that is calculated to achieve the purpose as herein disclosed.

Furthermore, a first control system 56 (shown in FIGS. 5A-5B) may control one or more gates. A second control system (not shown in FIGS. 5A-5B) is optional, and could control other gates. In the case of multiple control systems, the failure of one control system would not prevent the release of fluid from the apparatus 24, as redundancy and extra capacity may be built into the system.

Figure 4:
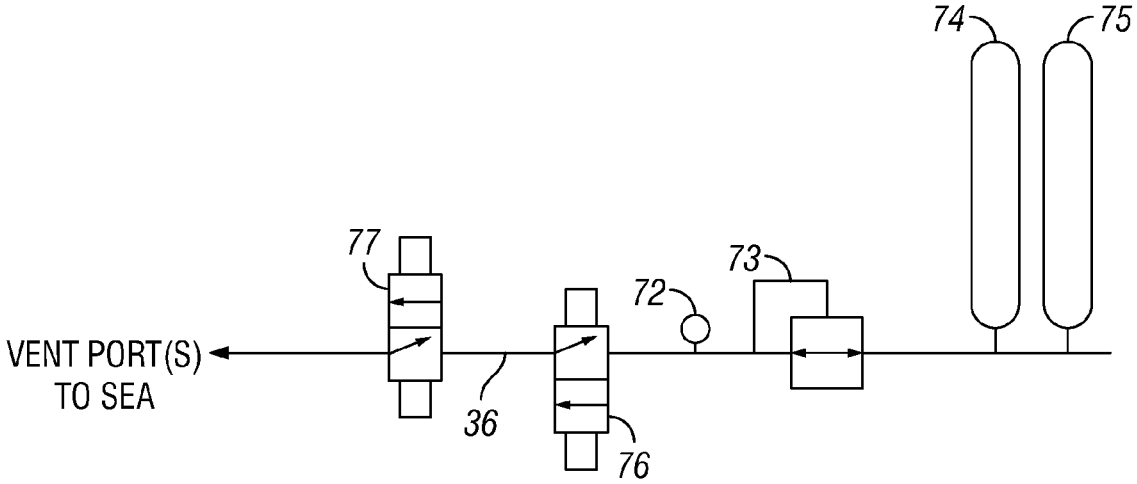
FIG. 4 is a schematic drawing revealing one manner of controlling the gates of the invention.

FIG. 4 shows a schematic of one embodiment of a control system that operates to open the dump joint apparatus 25. However, it should be recognized that another hydraulic, mechanical, or electrical system of a different design could be employed. Hydraulic power could be sourced from the blow out preventer, LMRP, or from a subsea mudlift pump. Further, a mechanical or electrically operated system also could be used, and a person of skill in the art will recognize that there are many alternatives available to actuation and opening of gates to release fluid upon a trigger event, such an emergency disconnect of the riser 24 or other event that makes it desirable to drain fluid from riser 24.

The simplified version of the controls circuit as depicted in FIG. 4 shows two (2) accumulators 74, 75 which may be in the form of separator or piston type accumulators for storing hydraulic fluid power. A pressure reducing hydraulic regulator 73 and a subsea depth compensated pressure gauge 72 each are provided, the latter being positioned for direct readout of available hydraulic pressure via regular remotely operated vehicle inspection intervals. Further, a two position arm/disarm valve 76 is provided for safe control of the apparatus 25 and a pilot operated two position trip valve 77 providing Emergency Disconnect (EDS) signal input as applied from the BOP control during an emergency disconnect event (i.e. one button—multiple events). The control circuit provides operators with a simple means of safely deploying and arming the RDJ and then upon completion of the drilling of the well, disarming and retrieving the assembly.

Options to override the RDJ controls via a remote operated vehicle ("ROV") may be included whereby the ROV can inject a pilot signal to trip a 2 position EDS valve and thereby open the gates 50*a-f* of the RDJ, allowing fluid to vent through port(s) to the sea. In addition, the ROV may also be capable of adding hydraulic fluid to the RDJ mounted accumulators 74, 75 in the event of an issue with the BOP controls supplying hydraulic fluid power to the RDJ system. The controls may be be capable of opening all redundant RDJ gates (such as those in redundant flow port section 57) as well as closing them. Override ROV options may be employed as part of the controls design.

With reference to FIG. 4, the system may be designed so that the closed gate position is the default setting, and activation causes the release of fluid from the riser 24. For example, a two position normally closed spring return valve may open spools (spools not shown). An arm/disarm feature may be employed, such that a control line 36 having multiple hydraulic lines (perhaps three lines, as an example) may extend from the lower marine riser package 30 (see FIG. 1) to the dump joint apparatus 25. The apparatus 25 further may be fitted with a remotely operated vehicle (ROV) fined retrievable relief valve for retrieval overpressure protection. Furthermore, one embodiment of the invention may also employ the possibility of ROV intervention by direct manual manipulation of ROV intervention connection 59 (see FIG. 2A). Other methods or systems of ROV intervention could be employed as well.

Figure 5A:
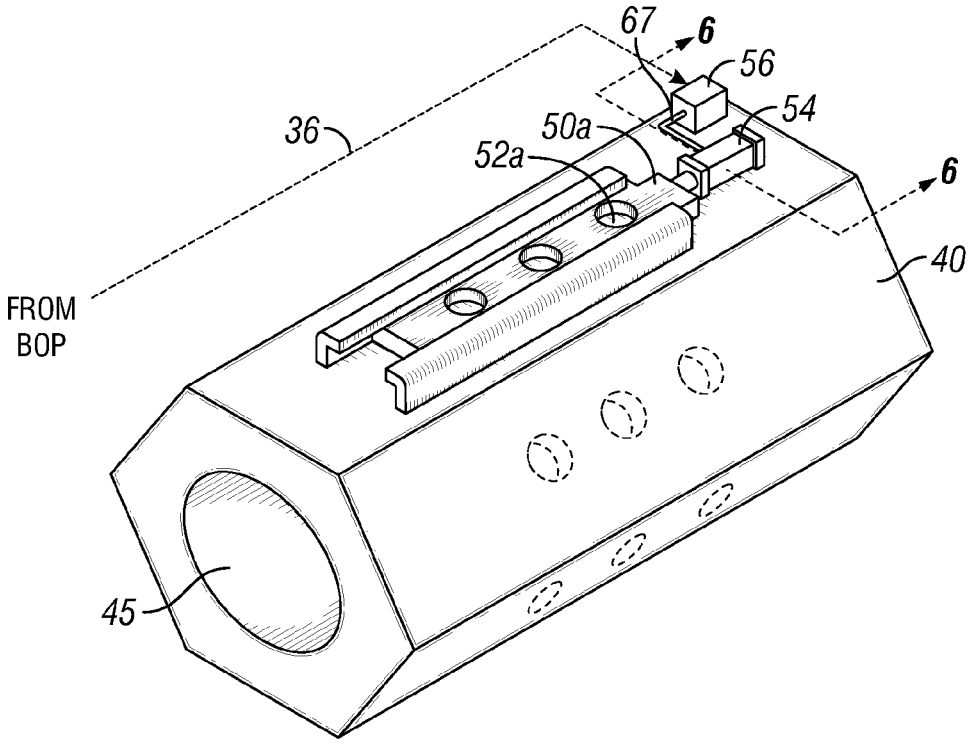
FIG. 5A is a partial view of the housing of the dump joint apparatus, with attention to one embodiment of a gate structure and actuator assembly, with the gate shown in the closed position, and with other components and gates removed for purposes of illustration.
Figure 5B:
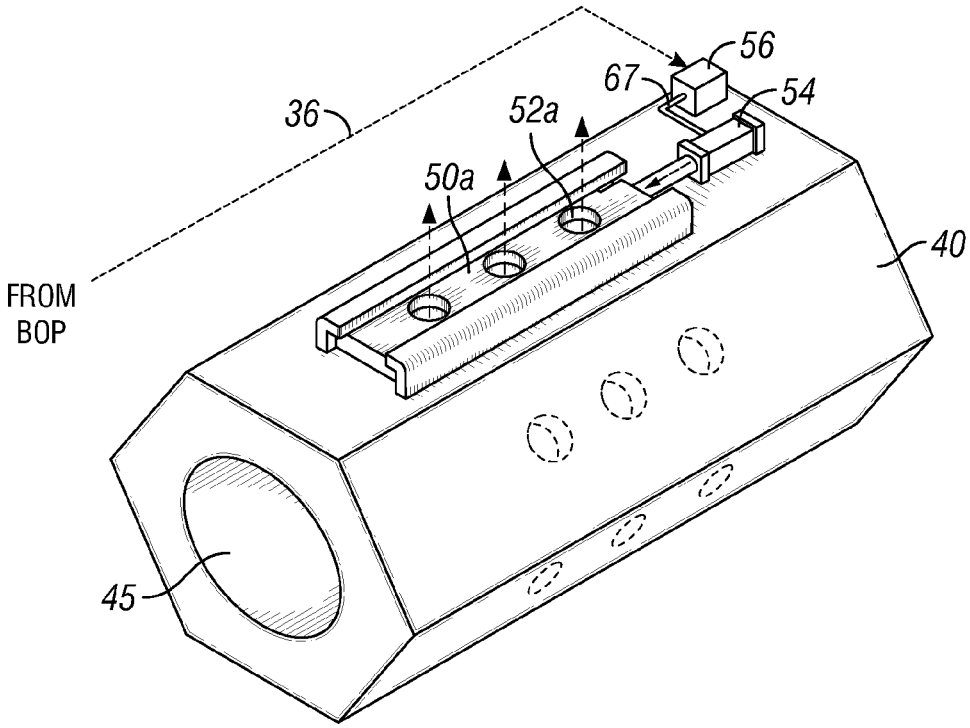
FIG. 5B shows the apparatus of FIG. 5A with the gate shown in the open position to release fluid from the housing.

FIG. 5A shows a partial view of the dump joint apparatus 25 with the gate 50*a* in the closed position. FIG. 5B shows the same gate 50*a* in the open position, following actuation. Both FIGS. 5A and 5B are shown with other gates and apparatus removed for purposes of illustration.

In FIG. 5A, first actuator assembly 54 is configured for receiving hydraulic power along hydraulic line 67, which is further connected to first control system 56. Control system 56 may be activated by a trigger, such as hydraulic power from the blow out preventer 36 upon emergency disconnect of the riser 24. Apertures in the gate 50*a* include for example aperture 52, which in FIG. 5A is not aligned with the corresponding ports located beneath it on the housing 40 in FIG. 5A so that fluid is not capable of passing out of aperture 52.

FIG. 5B shows the apparatus of FIG. 5A following activation along control line 36, in which hydraulic power passes along hydraulic line 67 to first actuator assembly 54, which causes sliding movement of the gate 50*a* to allow passage of fluids out of the central cavity 45 of the riser 24 along direction arrows as shown in FIG. 5B. In one embodiment, a movement of about six inches is enough to move the gate 50*a* into the fully open position to align port 48*a* with gate 50*a*. Aperture 52 may be of any shape, but circular may be advantageous. Further, ports also may be of any suitable shape and size, and may be sized to match the apertures, or not sized to match the apertures, as needed.

Figure 6:
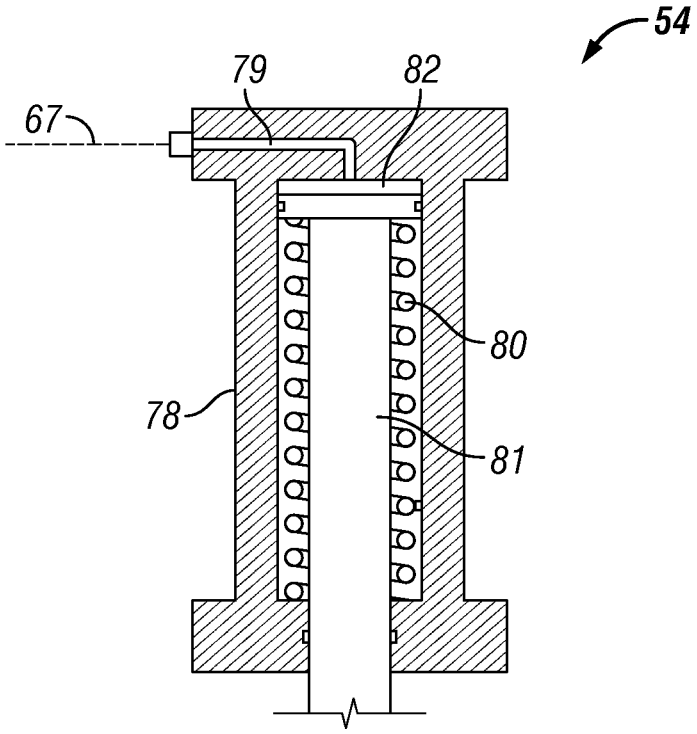
FIG. 6 is a cross sectional view of an actuator assembly in the embodiment of the invention shown in FIGS. 2A-5A.

FIG. 6 shows a cross sectional view of the first actuator assembly 54 as taken along lines 6-6 shown in FIG. 5A. In this embodiment, a spring 80 is employed to default the actuator to the closed position, with the gate 50*a* closed to fluids. Hydraulic pressure along hydraulic line 67 passes into the body 78 of the assembly 54, providing pressure along hydraulic conduit 79, thereby forcing hydraulic fluid into the hydraulic fluid cylinder 82. This forces shall 81 downward as hydraulic fluid pressure compresses the spring 80 to fill the cylinder 82. The mechanical movement downward of shaft 81 forces gate 50*a* into the open position as shown in FIG. 5B. The position of FIG. 5B may be maintained as long as hydraulic pressure is applied, and when pressure is removed, the closed position of FIG. 5A may be resumed.

Figure 7:
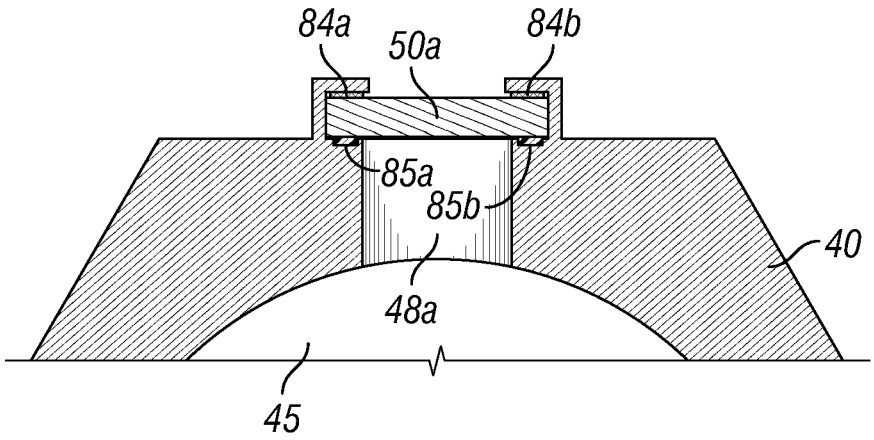
FIG. 7 is a close-up view of the gate as further indicated by FIG. 3.

FIG. 7 illustrates a cross sectional view of gate 50*a* (as also seen in FIG. 3). Gate 50*a* is retained in housing 40 and covers the port 48*a* when the gate 50*a* is in the closed position. Fluid in central cavity 45 (which surrounds the annular space of the drill string during drilling operations) extends into port 48*a*, and is released when the gate 50*a* slides open. Gate 50*a* rests upon seals 85*a*, 85*b*, which prevent fluid leakage during normal drilling operations, when gate 50*a* is in the closed position. Such seals may be elastomeric or combination of elastomeric and other materials suitable for subsea use. Additionally, low friction spacers 84*a*. 84*b* retain the opposite side (outside) of the gate 50*a* in position.

Figure 8A:
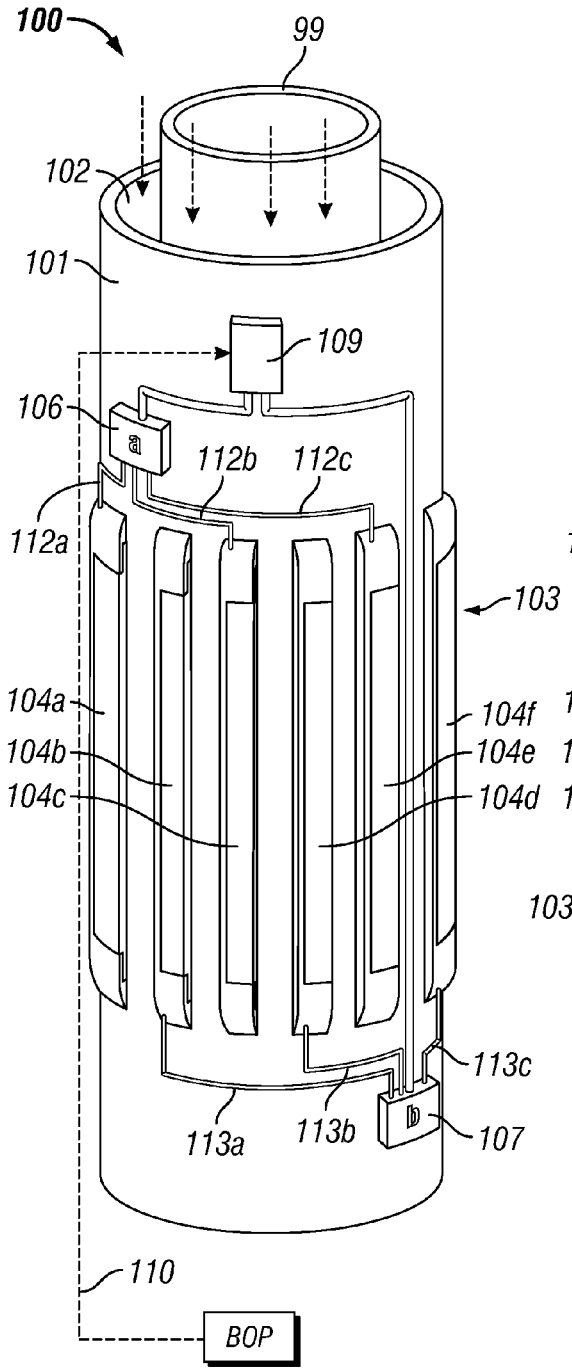
FIG. 8A shows a second embodiment of the dump joint apparatus invention with the gate in the closed position.
Figure 8B:
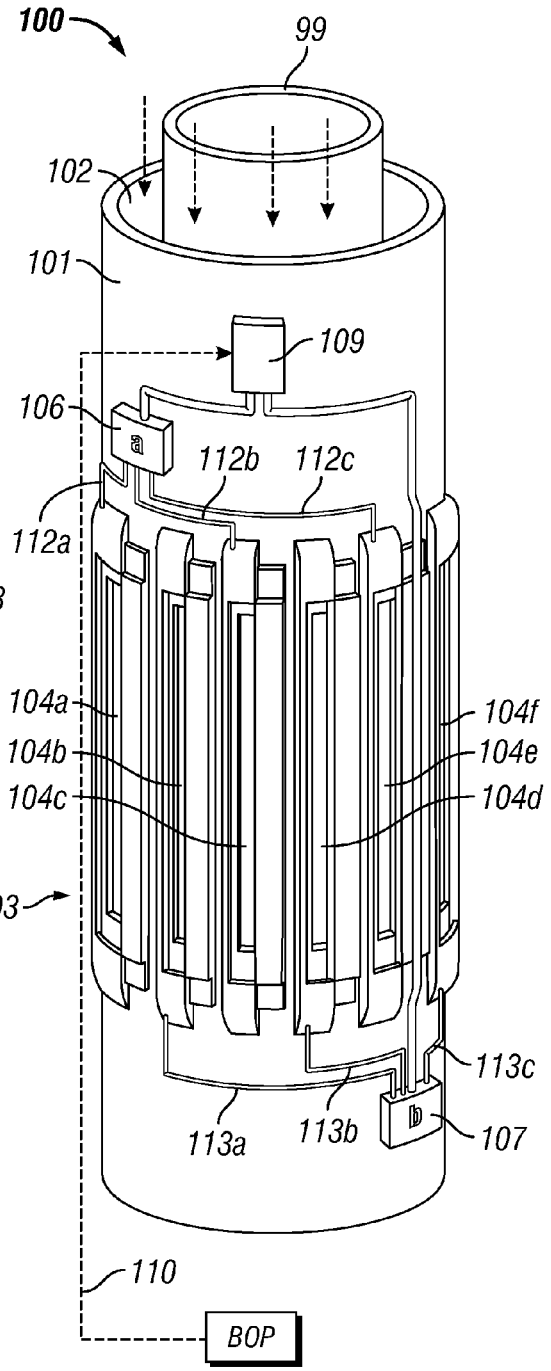
FIG. 8B shows the second embodiment of the dump joint apparatus invention of FIG. 8A, except that the gate is shown in the closed position.

An alternate embodiment of the invention is illustrated in FIGS. 8A, 8B, 9A, and 9B. In this alternate embodiment, a different mechanical arrangement is provided for release of fluid, although the mechanism for opening gates in this alternate embodiment is also a hydraulic system. FIG. 8A shows the apparatus with gates in the closed (default) position, while FIG. 8B illustrates the apparatus with gates moved to the closed position to facilitate fluid loss from the interior space 102 of housing 101.

FIG. 8A illustrates a riser dump apparatus 100 having a housing 101. A drill pipe 99 is shown positioned within the apparatus 100. The housing 101 includes interior space 102 (which forms the annular space surrounding the drill pipe 99) and also an exterior region 103 outside the housing 101. In this embodiment, gates 104*a-f* are provided in circumferential arrangement around the periphery of the housing 101. Gates 104*a*, 104*c*, and 104*e* connect to first actuator assembly 106 by way of hydraulic lines 112*a*, 112*b*, and 112*c* respectively. Likewise, gates 104*b*, 104*d*, and 104*f* connect to second actuator assembly 107 by way of hydraulic lines 113*a*, 113*b*, and 113*c* respectively.

Control system 109 receives a hydraulic pressure pulse or other signal along control line 110. This pressure signal activates the control system 109 which in turn activates first actuator assembly 106. Likewise, control system 109 activates second actuator assembly 107. Each of these actuator assemblies 106, 107 acts upon its respective gates. There is built-in redundancy so that upon failure of either actuator assembly to operate, the other actuator assembly likely may not be affected, as it operates independently, and the other actuator may accomplish the task of opening its respective gate(s) enough to provide adequate fluid flow capacity to drain fluid from the riser 24. This embodiment shows only one control system 109, but multiple control systems could be employed, depending upon engineering requirements.

Figure 9A:
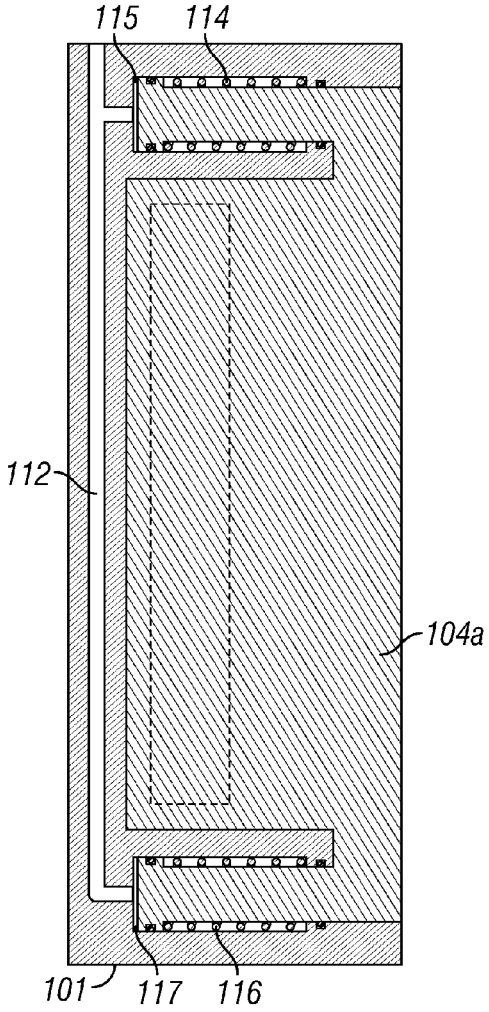
FIG. 9A illustrates the second embodiment of the dump joint apparatus invention of FIG. 8A in cross sectional view.
Figure 9B:
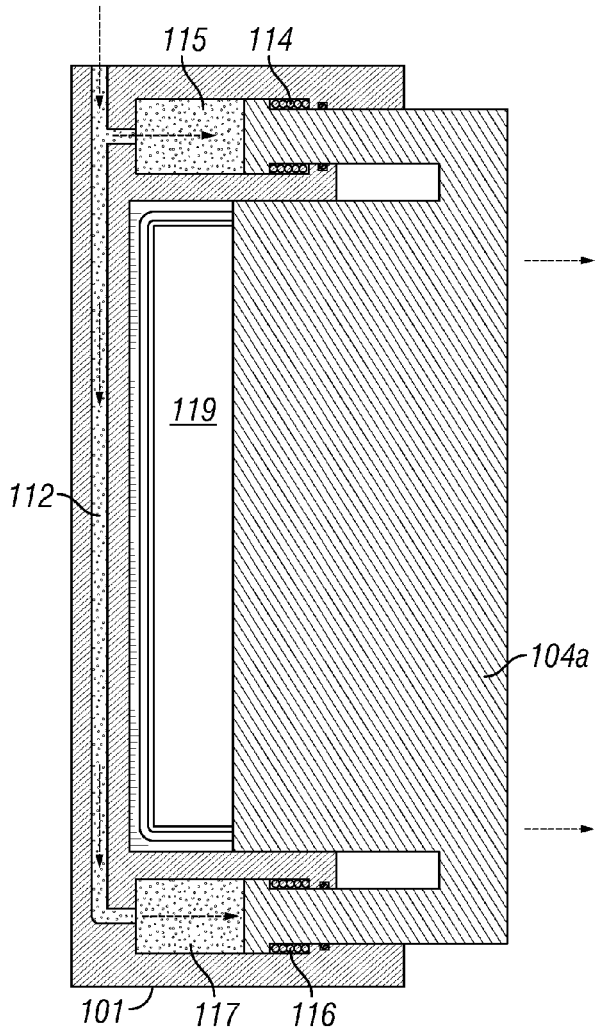
FIG. 9B illustrates the second embodiment of the dump joint apparatus invention of FIG. 8B in cross sectional view.

FIG. 9A shows a cross-sectional view of gate 104*a*, revealing how the gate 104*a* may be structured. Housing 101 includes hydraulic line 112 feeding into hydraulic cylinder 115. In the default (gate closed) mode, the springs 114 and 116 provide back pressure to keep hydraulic fluid from entering the cylinders 115, 117 respectively. However, upon activation of first actuator assembly 106, fluid enters cylinders 115, 117 exerting pressure to slide gate 104*a* to the open position, thereby exposing port 119, as seen in FIG. 9B. This enables the release of fluid through the port 119. A similar series of events may occur simultaneously for the other gates 104*a-f*, similar to that shown in FIG. 8B. Any number of gates 104*a-f* may be used, and this particular embodiment employs six (6) gates, although less or more gates could be employed, depending upon the configuration. Gates 104*a-f* may be deployed simultaneously or in series, and in some instances, the control system may activate the gates at different times, if desirable to do so, and if the control system is capable of time staged activation.

The invention may be further described by reference to the appended claims.

The invention claimed is:

1. An apparatus for releasing fluid from a riser assembly, the apparatus comprising:

(a) a housing defining an interior space and an exterior region, the housing having first and second ends adapted for respective sealed connection in the riser assembly, the housing being defined on its interior space by a central cavity, the central cavity being adapted for passage of a drill string, the housing further comprising at least one first port and at least one second port;

(b) a first gate in mating configuration with the housing, the first gate being moveable from (i) a sealed position that restricts fluid flow through the first port to (ii) an open position that facilitates fluid flow through the first port from the interior space to the exterior region of the housing;

(c) a first actuator assembly connected to the first gate and configured for moving the first gate from the sealed position to the open position;

(d) a second gate in mating configuration with the housing, the second gate being controlled independently of the first gate, the second gate being selectively moveable from (i) a sealed position that restricts fluid flow through the second port to (ii) an open position that facilitates fluid flow through the second port from the interior space to the exterior region of the housing; and (e) a second actuator assembly connected to the second gate and configured for moving the second gate from the sealed position to the open position.

2. The apparatus of claim 1 wherein the first actuator assembly is hydraulically operated.

3. The apparatus of claim 1 wherein the first actuator assembly is mechanically operated.

4. The apparatus of claim 2 wherein the first actuator assembly is in fluid communication with stored hydraulic fluid, the actuator assembly further having at least one valve, the valve being configured for opening to facilitate pressurized flow of the hydraulic fluid to move the first gate between the sealed and open positions.

5. The apparatus of claim 1 further comprising a third gate connected to a third actuator assembly.

6. The apparatus of claim 5 further comprising a fourth gate connected to a fourth actuator assembly.

7. The apparatus of claim 6 wherein the first and third gates are positioned on approximately opposite sides of the housing.

8. The apparatus of claim 7 wherein the second and fourth gates are positioned on approximately opposite sides of the housing.

9. The apparatus of claim 6 further comprising a fifth gate connected to a fifth actuator assembly.

10. The apparatus of claim 9 further wherein the housing is cylindrical in shape, the apparatus further comprising a sixth gate connected to a sixth actuator assembly, further wherein the first, second, third, fourth, fifth, and sixth gates are arranged in a space arrangement around the cylindrical periphery of the housing.

11. The apparatus of claim 1 further comprising:

(f) a first control system, the first control system being configured for activating the first actuator assembly in the event of an emergency disconnect of the riser assembly from a well.

12. The apparatus of claim 11 further comprising:

(g) a second control system, the second control system being configured for activating the second actuator assembly in the event of an emergency disconnect of the riser assembly from the well.

13. The apparatus of claim 12 wherein the first control system activates a plurality of actuator assemblies in the event of an emergency disconnect from the well, further wherein the second control system activates a plurality of actuator assemblies in the event of an emergency disconnect from the well, thereby facilitating a redundant operation.

14. An apparatus for releasing fluid from a riser assembly, the riser assembly being adapted for connection to a drilling structure positioned above or upon the surface of a sea, the riser assembly being adapted for extending below the sea to a lower marine riser package mounted upon a blowout preventer adjacent the top of a well, the apparatus comprising:

(a) a housing defining an interior space and an exterior region, the housing further comprising a plurality of ports;

(b) a first set of gates in mating configuration with the housing, the first set of gates each being selectively moveable from: (i) a sealed position that restricts fluid flow through one of the plurality of ports from the interior space to the exterior region of the housing to (ii) an open position that facilitates fluid flow through the one of the plurality of ports from the interior space to the exterior region of the housing;

(c) a first set of actuator assemblies connected to the first set of gates and configured for moving the first set of gates from the sealed position to the open position;

(d) a second set of gates operated independently from the first set of gates, the second set of gates being in mating configuration with the housing, the second set of gates being independently and selectively moveable from a sealed position that restricts fluid flow through another one of the plurality of ports to an open position that facilitates fluid flow through the another one of the plurality of ports from the interior space to the exterior region of the housing;

(e) a second set of actuator assemblies connected to the second set of gates and configured for moving the second set of gates from the sealed position to the open position.

15. The apparatus of claim 14 wherein the first set of gates further comprise apertures, further wherein the apertures are provided for alignment with the one of the plurality of ports of the housing when the first set of gates are in the open position.

16. A system for receiving a drill string, the system being suspended from a drilling structure, the system comprising:

(a) a riser, the riser being configured for the transport of drilling fluid, (b) an apparatus in sealed connection to the riser, the apparatus comprising:

(i) a housing defining an interior space and an exterior region, (ii) a first port and a second port through the housing;

(iii) a first gate in mating configuration with the housing, the first gate being moveable from a sealed position to an open position that facilitates fluid flow through the first port;

(iv) a first actuator assembly connected to the first gate and configured for moving the first gate from the sealed position to the open position;

(v) a second gate in mating configuration with the housing, the second gate being operable and moveable independently from the first gate, the second gate being moveable from a sealed position to an open position that facilitates fluid flow through the first port; and (vi) a second actuator assembly connected to the second gate and configured for moving the second gate from the sealed position to the open position, the second actuator assembly being independently operable.

17. A method of releasing fluids from a drilling riser in the event of an emergency disconnect of the riser from a well, the method comprising the steps of:

(a) providing a fluid release apparatus in sealed connection to the riser, the fluid release apparatus comprising a housing defining an interior space and an exterior region, the apparatus further comprising at least one first port and a first gate in mating configuration to the first port, the first gate being moveable from a sealed position which blocks fluid flow through the first port to an open position that facilitates fluid flow through the first port, providing a second gate, the second gate being moveable independently from the first gate, the second gate being moveable from a sealed position which covers at least one second port to an open position that facilitates fluid flow through the second port, (b) providing a first actuator assembly, the first actuator assembly configured for moving the first gate from the sealed position to the open position, (c) providing a second actuator assembly operable independently from the first actuator assembly, the second actuator assembly being configured to move the second gate from the sealed position to the open position, (d) activating the first actuator assembly to move the first gate to the open position, (e) independently activating the second actuator assembly to move the second gate to the open position, and (f) flowing fluid from the interior space of the riser through the first port and the second port to the exterior region of the riser.

18. The method of claim 17 wherein the first actuator assembly is hydraulically operated.

19. The method of claim 18, wherein the activating step (c) further comprises providing stored hydraulic fluid in communication with the actuator assembly, the actuator assembly further comprising at least one valve, whereby during the activation step the valve is opened to facilitate pressurized flow of the hydraulic fluid to move the first gate to the open position.

20. The method of claim 17 wherein a plurality of ports are provided upon the apparatus.

21. The method of claim 17 wherein a control system is provided, the control system being configured for activating the first actuator assembly upon emergency disconnect of the riser from the well.

* * * * *